US009763848B1

(12) United States Patent
Handzic et al.

(10) Patent No.: US 9,763,848 B1
(45) Date of Patent: Sep. 19, 2017

(54) WALKING ASSISTANCE DEVICES INCLUDING A CURVED TIP HAVING A NON-CONSTANT RADIUS

(71) Applicants: Ismet Handzic, Lutz, FL (US); Kyle B. Reed, Tampa, FL (US)

(72) Inventors: Ismet Handzic, Lutz, FL (US); Kyle B. Reed, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 14/801,776

(22) Filed: Jul. 16, 2015

Related U.S. Application Data

(60) Provisional application No. 62/025,173, filed on Jul. 16, 2014.

(51) Int. Cl.
*A61H 3/02* (2006.01)
*A45B 9/04* (2006.01)

(52) U.S. Cl.
CPC ..... *A61H 3/02* (2013.01); *A45B 9/04* (2013.01); *A61H 3/0288* (2013.01); *A61H 2003/0211* (2013.01)

(58) Field of Classification Search
CPC A61H 3/02; A61H 2003/0211; A61H 3/0288; A45B 9/04
See application file for complete search history.

(56) References Cited

U.S. PATENT DOCUMENTS 3,986,502 A 10/1976 Gilson
4,493,334 A * 1/1985 Semanchik ..... A45B 9/00 135/75
4,756,524 A 7/1988 Cooney
5,301,704 A 4/1994 Brown
5,331,989 A * 7/1994 Stephens ..... A45B 9/00 135/65
5,409,029 A 4/1995 Davis
5,533,536 A 7/1996 Hong
5,566,700 A * 10/1996 Brown ..... A45B 9/02 135/72
6,003,533 A * 12/1999 Midcap ..... A45B 9/04 135/44
7,686,025 B1 * 3/2010 Dowling ..... A45B 9/04 135/66

(Continued)

FOREIGN PATENT DOCUMENTS

DE 102004043500 * 3/2006

OTHER PUBLICATIONS

Nielsen, David H., et al. "Energy cost, exercise intensity, and gait efficiency of standard versus rocker-bottom axillary crutch walking." Physical therapy 70.8 (1990): 487-493.

(Continued)

*Primary Examiner* — Noah Chandler Hawk

(74) *Attorney, Agent, or Firm* — Thomas | Horstemeyer, LLP

(57) ABSTRACT

In one embodiment, a walking assistance device includes a support member adapted to support a user of the device and a curved tip mounted to the support member, the curved tip including a curved outer surface adapted to contact the ground or a floor surface during use of the device, the curved outer surface having a non-constant radius that changes as a function of angular position along the curved outer surface.

12 Claims, 13 Drawing Sheets

(56) References Cited

U.S. PATENT DOCUMENTS

| | | | | |
|---|---|---|---|---|
| 8,342,196 | B2 * | 1/2013 | Weber | A61H 3/02 135/69 |
| 8,408,224 | B2 * | 4/2013 | Ozuna | A45B 9/04 135/65 |
| 8,662,094 | B2 * | 3/2014 | Amladi | A45B 9/04 135/84 |
| 2008/0121260 | A1 * | 5/2008 | Stephens | A45B 9/00 135/75 |
| 2010/0206348 | A1 * | 8/2010 | Markou | A61H 3/02 135/71 |
| 2010/0229903 | A1 | 9/2010 | Ozuna et al. | |
| 2013/0152986 | A1 * | 6/2013 | Hunter | A61H 3/02 135/66 |
| 2013/0291913 | A1 | 11/2013 | Soletski et al. | |
| 2013/0298953 | A1 | 11/2013 | Amladi | |
| 2014/0090677 | A1 | 4/2014 | Butler | |

OTHER PUBLICATIONS

Basford, J. R., H. L. Rhetta, and M. P. Schleusner. "Clinical evaluation of the rocker bottom crutch." Orthopedics 13.4 (1990): 457-460.

Foreign search report for PCT/US15/40806 dated Dec. 8, 2015.

* cited by examiner

WALKING ASSISTANCE DEVICES INCLUDING A CURVED TIP HAVING A NON-CONSTANT RADIUS

CROSS-REFERENCE TO RELATED APPLICATION

This application claims priority to U.S. Provisional Application Ser. No. 62/025,173, filed Jul. 16, 2014, which is hereby incorporated by reference herein in its entirety.

NOTICE OF GOVERNMENT-SPONSORED RESEARCH

This invention was made with Government support under grant/contract number 1319802 awarded by the National Science Foundation. The Government has certain rights in the invention.

BACKGROUND

Throughout history, the walking crutch has been used as a type of walking assistance device. Although the crutch has evolved over time, its fundamental design is generally the same. Such crutches, and other walking assistance devices such as canes, have a point tip on which the device can be rolled or pivoted. In the case of a crutch, the user supports himself or herself with the device and swings over the crutch tip. This type of crutch gait cycle is known as swing-through non-weight bearing crutch walking.

The effort of the swing-through crutch gait has a higher net metabolic cost per unit distance than running. This leaves users fatigued and limits their everyday crutch walking range. Although there have been improvements in crutch design, they have generally targeted crutch-user interaction, such as crutch grip and torso support, and limited research has been performed to advance crutch-ground interactions in order to modify or control user dynamics. This is unfortunate as crutch users include chronically disabled individuals who rely on their crutches for everyday ambulation. It would be desirable to be able to manipulate the crutch (or other walking assistance device) and, in turn, the user's dynamics, such that that the device assists user ambulation.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, conventional walking assistance devices, such as crutches, canes, walking sticks, and the like, have point tips that do not assist or resist the swinging dynamics or motion of the user. It would be desirable to be able to manipulate the device's ground forces to assist user ambulation. Disclosed herein are walking assistance devices have non-constant radius curved tips that are designed to provide a desired assistive motion for the user. Specifically, the radius of the tip changes as a function of the angle as the user swings or rolls over the device. Because a shape always rolls towards a decreasing radius on a flat surface, device tips can be made such that the user's swing or roll is assisted (decreasing radius) or resisted (increasing radius). Such a device tip makes walking uphill much more energy efficient while enabling the user to descend downhill with less speed and with greater control. In some embodiments, the curvature of the tip can be changed, in some cases in real time during use, either manually or automatically.

In the following disclosure, various specific embodiments are described. It is to be understood that those embodiments are example implementations of the disclosed inventions and that alternative embodiments are possible. All such embodiments are intended to fall within the scope of this disclosure.

Figure 1:
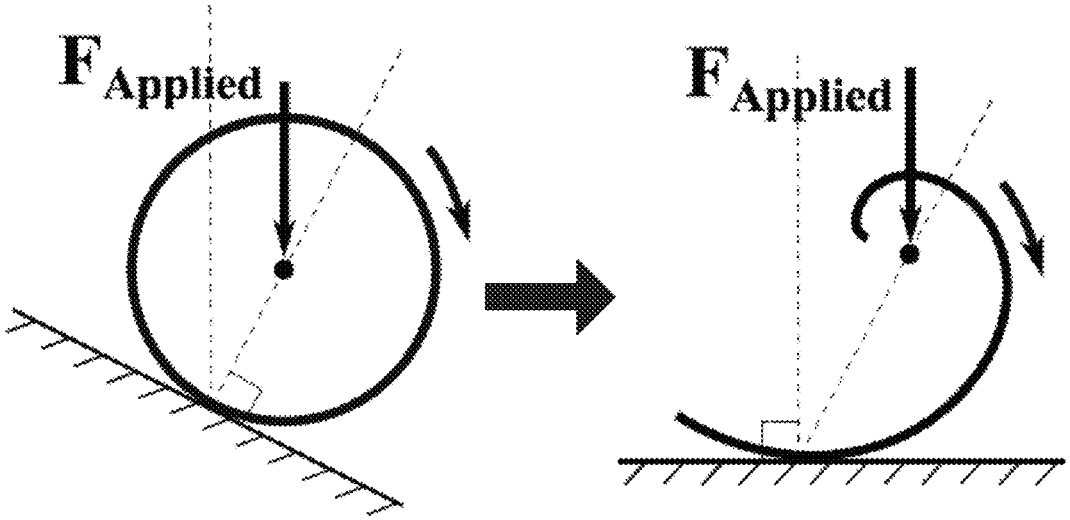
FIG. 1 is a schematic diagram that compares constant and non-constant radius curved shapes.

It is known that a two-dimensional circular object will roll down a decline. Similarly, it is also known that a curved object with a changing radius will roll on a flat surface and toward the decreasing radius. These phenomena are illustrated in FIG. 1. A two-dimensional shape can be formed such that it will roll uphill by designing the shape so that its decrease in radius is steeper than the decrease in elevation of the incline. Alternatively, the shape can be designed such that it will resist downward rolling by having the increase in radius steeper than the decrease in elevation. If the same vertical force is applied to the axis of both shapes shown in FIG. 1, each shape will roll in the exact same manner.

The disclosed walking assistance devices, which can take the form of a crutch, cane, or other device upon which the user places a portion of his or her weight to help him or her to stand or walk, comprise non-constant radius curved tips that function in a similar manner to the non-constant radius curved shape shown in FIG. 1. When utilized in a walking assistance device, the curved tips can passively apply assistive forces to reduce user energy input.

Figure 2A:
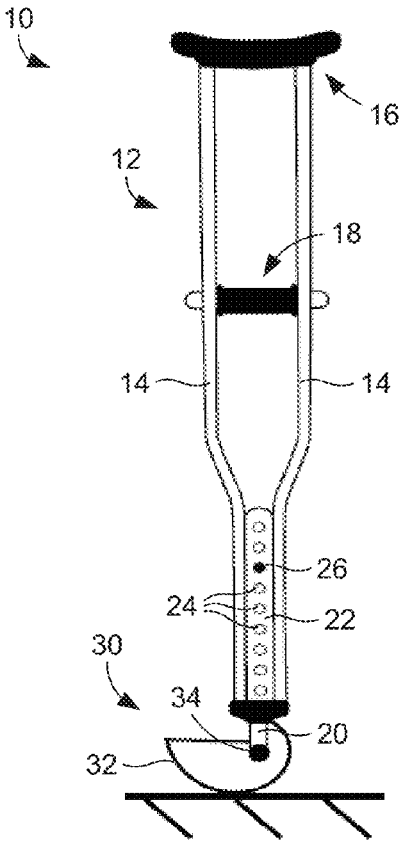
FIG. 2A is a side view of a crutch that includes a non-constant radius curved tip.

FIG. 2 illustrates one example of such a walking assistance device. More particularly, FIG. 2 shows a crutch 10 that is provided with a non-constant radius curved tip. Beginning with FIG. 2A, the crutch 10 comprises a frame 12 that includes one or more vertical support members 14 upon which a user can apply his or her weight. In the illustrated embodiment, two such support members 14 are provided and can, for example, comprise wooden or metal shafts or tubes. Extending between the support members 14 are horizontal support members, which include a padded underarm support 16 and a padded hand grip 18. The underarm support 16 extends between the top ends of the vertical support members 14, while the hand grip 18 extends between the vertical support members at a medial point along their lengths. In some embodiments, the vertical position of the hand grip 18 can be adjusted to suit the dimensions of the user.

Figure 2B:
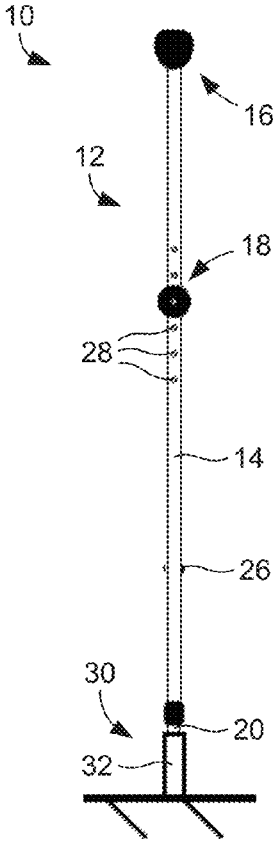
FIG. 2B is a front view of the crutch of FIG. 2A.

Extending downward from the bottom ends of the vertical support members 14 is a further vertical support member in the form of an extensible leg 20. In the illustrated embodiment, the leg 20 is housed within an outer tube 22 having multiple adjustment holes 24 and the leg comprises one or more detents 26 that can seat within the holes to fix the axial position of the leg relative to the outer tube, and therefore the vertical support members 14. As shown in FIG. 2B, similar adjustment holes 28 can be provided in the vertical support members 14 to enable height adjustment of the hand grip 18.

Mounted to the bottom end of the extensible leg 20 is a non-constant radius curved tip 30. As shown in FIG. 2A, the curved tip 30 has a curved outer surface 32 that lies within a plane generally parallel to the saggital plane of the user during use and whose radius from a center 34 of the curve, which lies along the longitudinal axis of the leg 20, changes as a function of the angular position along the surface. In the example of FIG. 2A, the portion of the surface 32 to the right in the drawing has a relatively small radius while the portion of the surface to the left in the drawing has a relative large radius. More particularly, the radius of the surface 32 gradually increases (or decreases depending upon the direction with which the surface is traversed) from one end of the surface to the other. For example, the radius can increase/decrease at a constant rate. As described below, the varying radius can assist the crutch user in walking uphill or downhill depending upon the orientation of the curved tip 30 relative to the hill.

Figure 3:
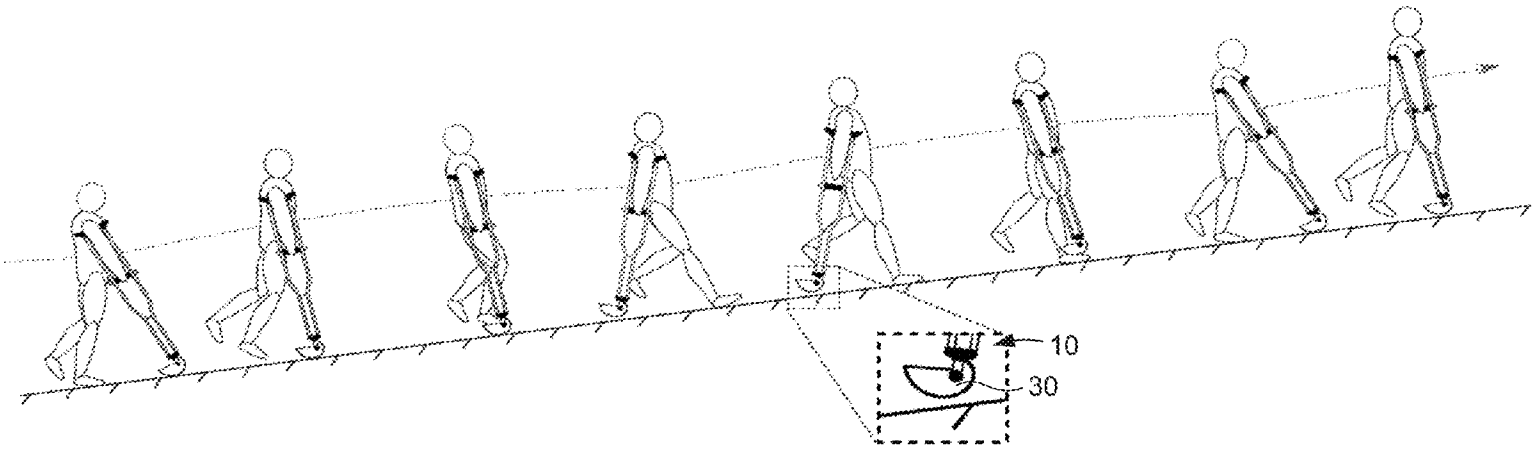
FIG. 3 is a schematic illustration of a user walking uphill using the crutch of FIG. 2.
Figure 4:
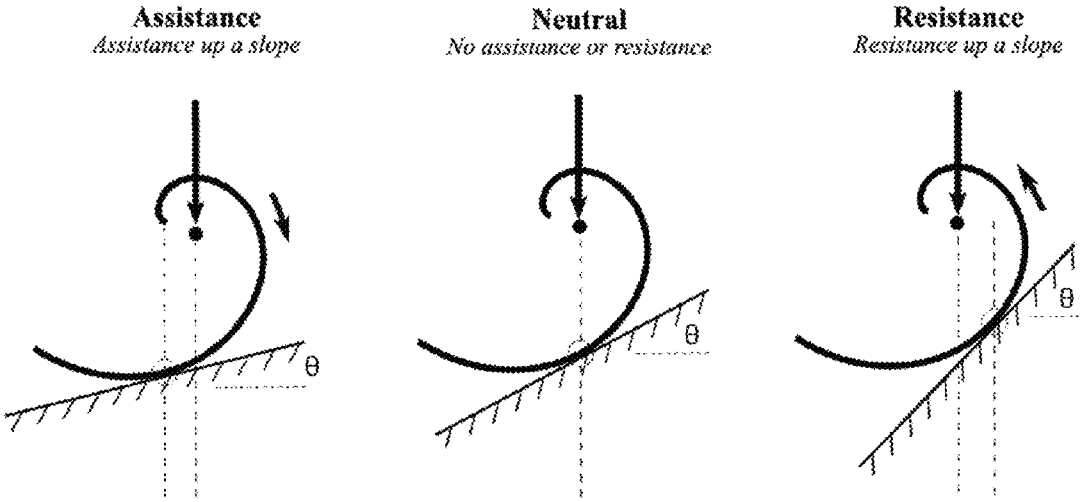
FIG. 4 includes schematic drawings illustrating the assistance provided by a non-constant radius curved shape relative to three different angles of inclination.

FIG. 3 illustrates an example application for the crutch 10 of FIG. 2. In this example, a user is shown walking up a hill (in sequential steps) with the assistance of the crutch 10. As shown in FIG. 3, the crutch 10 is oriented such that the front end of the non-constant radius curved tip 30 (facing uphill) is the small radius end of the tip. Because of this, the curved tip 30 tends to roll uphill and thus assists the user in walking up the hill. The degree of assistance that is provided by the curved tip 30 depends upon its varying radius as well as the steepness of the hill. This phenomenon is illustrated in FIG. 4. As shown in this figure, the non-constant radius curved shape can assist the user in walking uphill for a relatively small angle of inclination, θ (left). As θ increases (center and right), however, the assistance provided by the curved shape is reduced.

Figure 5:
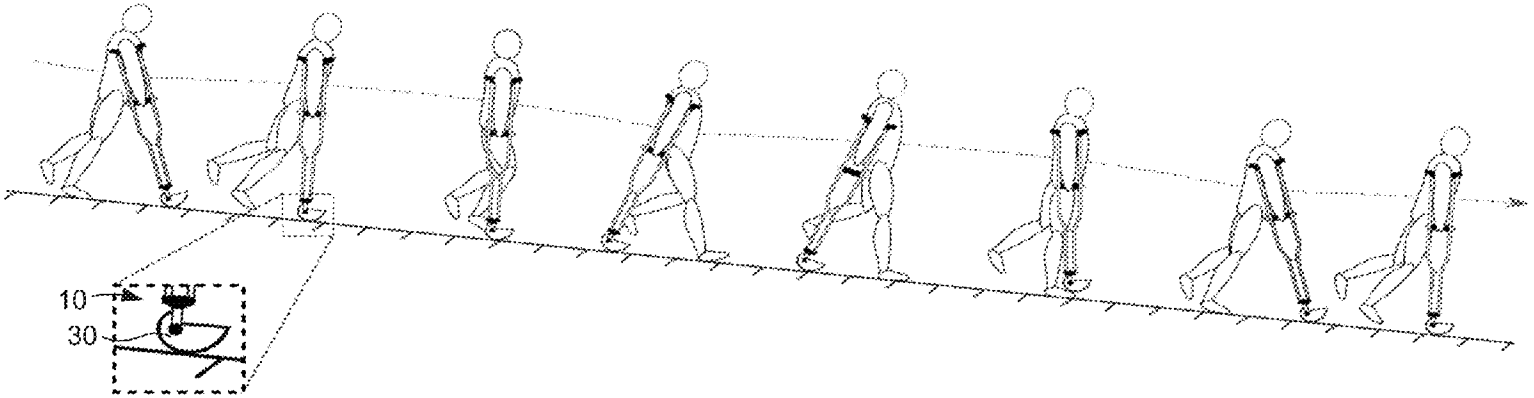
FIG. 5 is a schematic illustration of a user walking downhill using the crutch of FIG. 2 but in a different orientation than that shown in FIG. 3.

FIG. 5 illustrates another example application for the crutch 10 of FIG. 2. In this example, a user is shown walking down a hill (in sequential steps) with the assistance of the crutch 10. As shown in FIG. 5, this time the crutch 10 is oriented such that the front end of the non-constant radius curved tip 30 (facing downhill) is the large radius end of the tip. Because of this, the curved tip 30 still tends to roll uphill and therefore slows the user's progress when walking downhill, thereby providing walking assistance to the user.

The non-constant radius of the curved outer surface 32 can also assist the user as he or she walks on a level surface. For example, the orientation shown in FIG. 3 (i.e., increasing radius front to back) can assist the user in walking on a level surface and lower the user's energy expenditure during locomotion. Of course, the shape and/or magnitude (scale) of the curve can be adjusted depending upon the situation. For example, the change in curvature and/or magnitude of the curved surface may be relatively large for walking uphill and relatively small for walking on a level surface. It is also noted that the curvature can be selected to assist the user in standing upright or even to enable the crutch to stand upright by itself without falling over when released.

Although the center 34 of the curved outer surface 32 is shown in FIGS. 2, 3, and 5 as being located along the longitudinal axis of the extensible leg 20 (and therefore the central longitudinal axis of the crutch 10), the center can be located in other positions. Furthermore, while the curved outer surface 32 is shown having a gradually (e.g., constantly) increasing radius, the radius of the surface can vary in other ways, such as at an exponential rate. In some embodiments, the curved outer surface 32 can be based on a spiral. The spiral can be defined analytically as an Archimedean spiral, Cornu, spiral, Fermat's spiral, Hyperbolic spiral, lituus, logarithmic spiral, an involute circle, or some other analytic formulation. In contrast to an analytic curvature definition, the curved outer surface can also be defined discreetly with course or fine resolutions to produce its curvature. Furthermore, the radius decrease or increase can be defined as a curve fitted (linear, polynomial, spline, etc.) to discrete points or measurements to produce a non-constant radius tip curve.

It is further noted that two or more non-constant radius curves can be combined to form a unique non-constant radius curve tip that is specifically designed for particular applications, such as particular walking slope angles, types or walking environments, or modes of application (fast walking, slow walking, etc.).

If the non-constant radius curved tip sinks into an elastic or deformable ground or if the tip itself is deformable, its curvature may lose its effect. However, this can be accommodated by defining a more drastic curvature (greater radius change). For example, a compliant (e.g., rubber) non-constant radius tip that is used on a soft grass may need to have a larger radius change (increase or decrease) in order to produce its assistive or resistive function.

It is also noted that a constant radius curve with its center offset from the longitudinal axis of the leg will also produce a non-constant radius curve that has its center along the leg of the walking assistance device.

Figure 6:
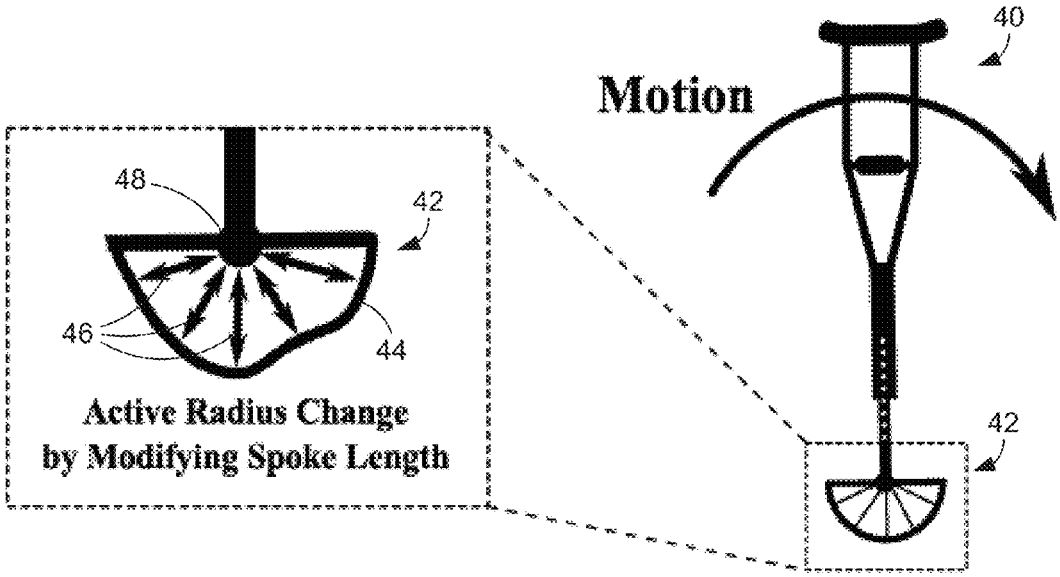
FIG. 6 is a schematic diagram of a crutch having a non-constant radius curved tip whose radius can be changed at discrete points along the curved tip.

In the above-described examples, the curved tip of a crutch is described as having a non-constant radius that is fixed, i.e., that cannot be changed. In other embodiments, the radius of the curved tip can be changed. FIG. 6 illustrates such an embodiment. In the example of FIG. 6, a non-constant radius curved tip 42 of a crutch 40 comprises a curved outer surface 44 whose curvature can be adjusted using multiple adjustment elements in the form of linearly adjustable spokes or struts 46 that extend out from a center 48 of the curve. In such a case, the user can adjust the lengths of one or more of the struts 46 (and therefore the radius of the curve) to create a curvature for the curved outer surface 44 that suits a particular application in which the crutch 40 is going to be used. The struts 46 can either be manually adjusted by the user using a non-motorized mechanism or electronically adjusted using a motorized mechanism.

In other embodiments, the struts 46 (and the radius of the outer curved surface 44) can be actively changed during use of the crutch 40. For example, the lengths of the struts 46 can be automatically adjusted without action by the user by a microcontroller/computer that is programmed to determine the surface curvature that would be best to assist the user and issue adjustment commands that cause the struts to adjust in length. This determination can, in some embodiments, be made by the microcontroller/computer relative to information collected by one or more kinematic or kinetic sensors associated with the crutch. For example, the radius change could be made relative to one or more of a measured speed, acceleration, force, position, or condition (e.g., the user is about to fall). Regardless, in some embodiments, it is preferred that the struts 46 or other means do not require power to maintain a particular radius. In such a case, power consumption is reduced as it is only required when changing the radius.

Figure 7A:
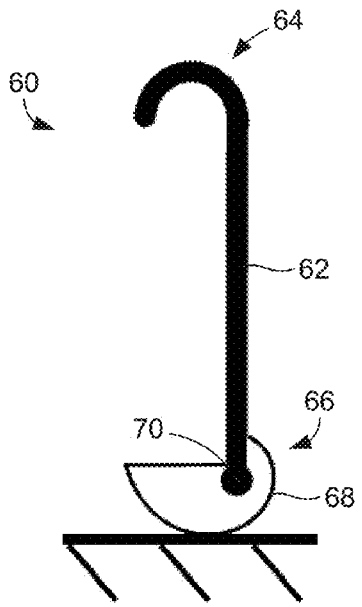
FIG. 7A is a side view of a cane that includes a non-constant radius curved tip.
Figure 7B:
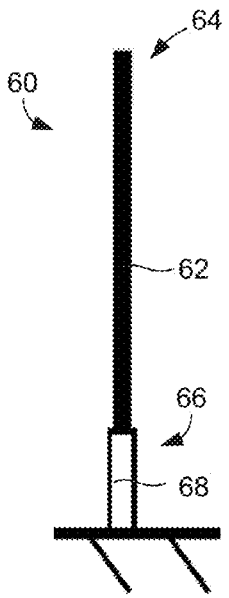
FIG. 7B is a front view of the cane of FIG. 7A.

The above-described principles can be applied to several types of walking assistance devices other than crutches, including as walking canes, quad canes, or assistant walkers. FIG. 7 illustrates one example of a walking cane 60 that is provided with a non-constant radius curved tip. Beginning with FIG. 7A, the cane 60 comprises a vertical support member 62 that is provided with a downwardly curved top end that forms a hand grip 64 that the user can grasp. As with the crutch 60, the support member 62 can, for example, comprise a wooden or metal shaft or tube.

Mounted to a bottom end of the vertical support member 62 is a non-constant radius curved tip 66. As shown in FIG. 7A, the curved tip 66 has a curved outer surface 68 whose radius from a center 70 of the curve changes as a function of the angular position along the surface. In the example of FIG. 7A, the portion of the surface 68 to the right in the drawing has a relatively small radius while the portion of the surface to the left in the drawing has a relative large radius. More particularly, the radius of the surface 68 gradually increases (or decreases depending upon the direction with which the surface is traversed) from one end of the surface to the other. For example, the radius can increase/decrease at a constant rate.

Figure 8:
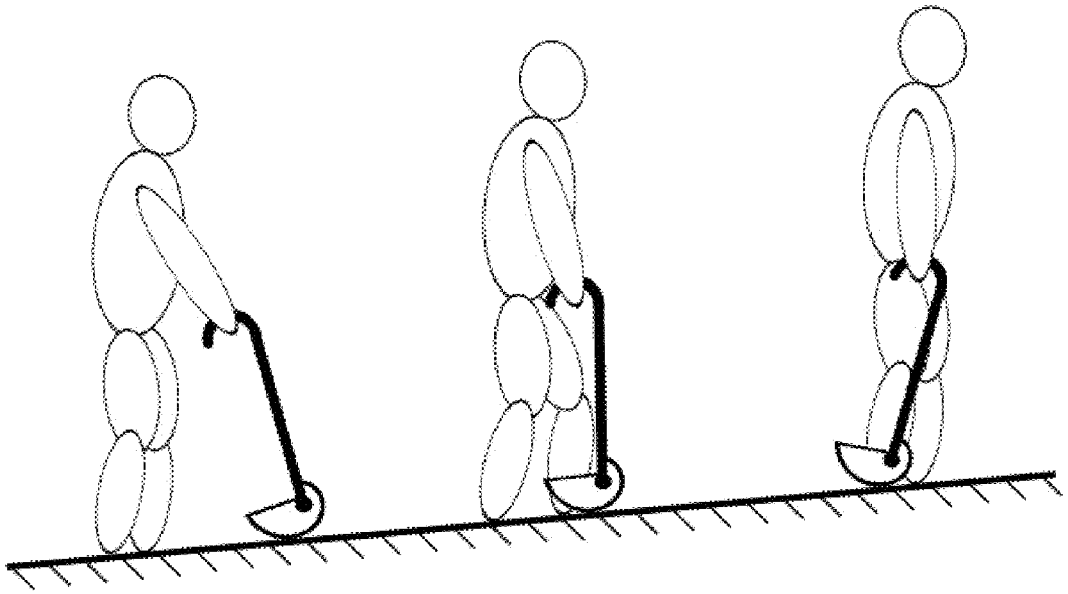
FIG. 8 is a schematic illustration of a user walking uphill using the cane of FIG. 7.

The varying radius of the curved outer surface 68 can also assist a user in walking uphill or downhill. The former type of assistance is illustrated in FIG. 8. As shown in this figure, the cane 60 is oriented such that the front end of the non-constant radius curved tip 66 (facing uphill) is the small radius end of the tip. Because of this, the curved tip 66 tends to roll uphill and thus assists the user in walking up the hill.

Figure 9A:
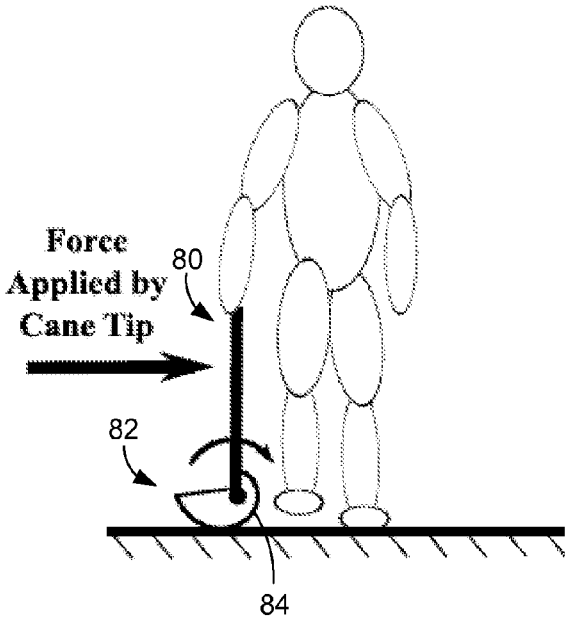
FIGS. 9A and 9B are schematic illustrations of a user supporting his weight using a cane having a non-constant radius curved tip whose radius changes along a direction lateral to the user.
Figure 9B:
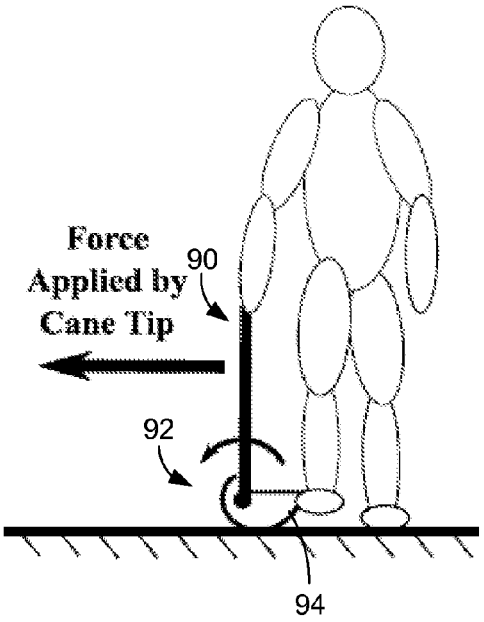

In the above-described embodiments, the curved outer surface of the walking assistance device and its non-constant radius lie in a plane that is generally parallel to the saggital plane of the user during use. It is noted, however, that the curved outer surface can lie in other planes, such as the coronal plane of the user. FIG. 9 illustrates examples of canes that have such outer surfaces. In FIG. 9A, a cane 80 includes a non-constant radius curved tip 82 having a curved outer surface 84 whose radius increases as the surface extends away from the user along the coronal (lateral) direction. This causes the cane 80 to tend to roll toward the user and therefore apply an inward force directed toward the user. In FIG. 9B, a cane 90 includes a non-constant radius curved tip 92 having an outer curved surface 94 whose radius decreases as the surface extends away from the user along the coronal (lateral) direction. This causes the cane 80 to tend to roll away from the user and therefore apply an outward force away from the user.

It is noted that, in addition to providing a curved tip having a radius that only increases or decreases, a curved tip can be constructed to have a radius that changes direction during the roll-over motion. For example, a crutch tip can be made such that the front of the tip has a decreasing radius that helps the user roll the crutch tip over during the beginning of the support phase and the rear of the tip has an increasing radius that resists the user during the end of the support phase.

Figure 17A:
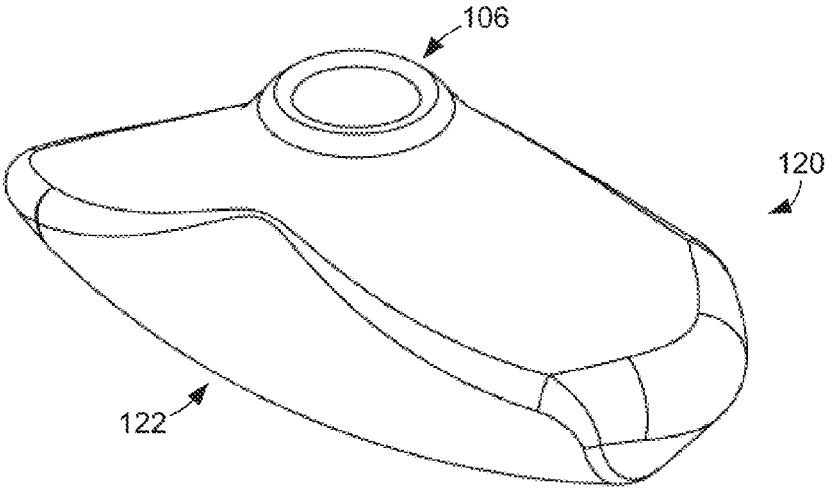
FIG. 17A is a top perspective view of a second example design for a non-constant radius curved tip.
Figure 17B:
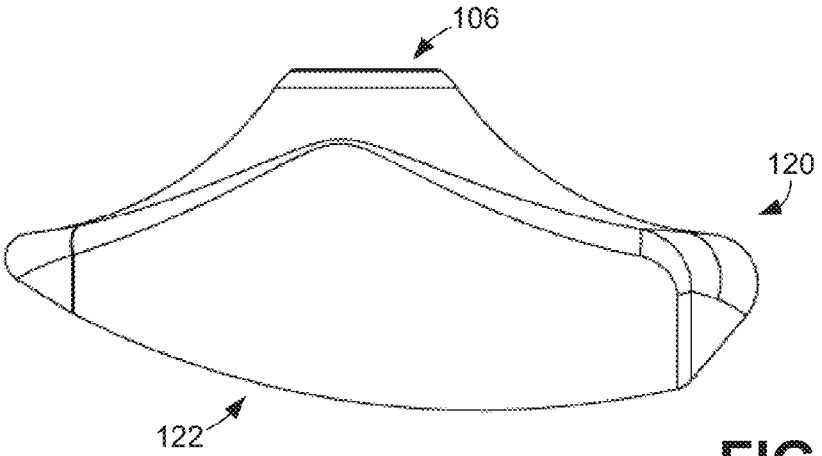
FIG. 17B is a side view of the curved tip of FIG. 17A.
Figure 17C:
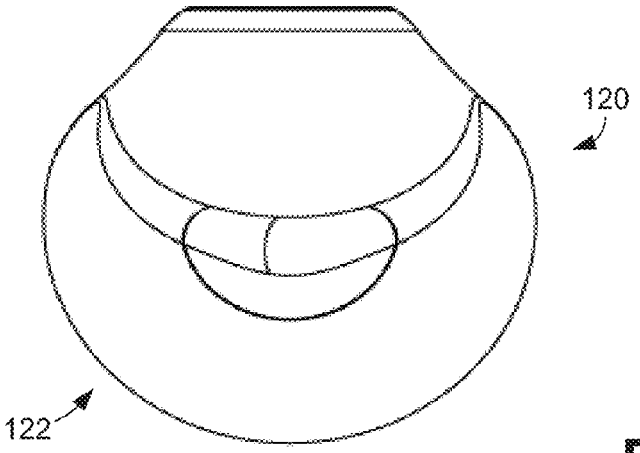
FIG. 17C is an end view of the curved tip of FIG. 17A.

It is further noted that the curved tip of a walking assistance device need not have a curvature that varies only in one direction. In other embodiments, the curvature of the curved tip can vary in multiple directions (e.g., front-to-back and side-to-side) at the same time so as to have a complex three-dimensional shape that assists the user in multiple directions at the same time. FIG. 17, which is described below, provides an example of such a curved tip.

Experiments were performed to test the effect of non-constant radius curved tips in walking assistance devices. Described below are results for a particular embodiment of a non-constant radius curved tip applied to an underarm crutch. In the experimentation, three different crutch tips were investigated:

1. Conventional rubber crutch tip,
2. Non-constant radius tip having a radius decreasing from back to front (forward forcing or assisting), and
3. Non-constant radius tip having a radius increasing from back to front (backward forcing or resisting).

The non-constant radius crutch tips (tips 2 and 3) had a radius increase/decrease to where 30% of the applied weight transfers to assisting or resisting force. Tips 2 and 3 were the same crutch tips rotated 180 degrees, which is illustrated in FIG. 10.

Figure 10:
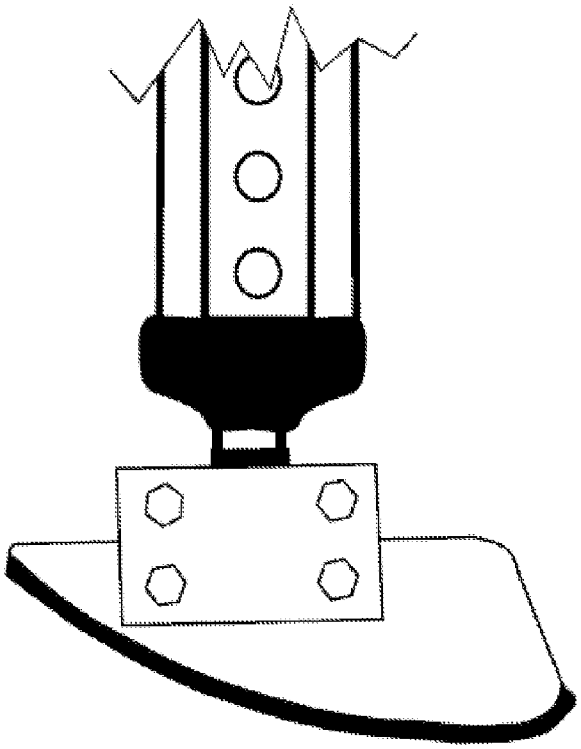
FIG. 10 is a side view of a non-constant radius curved tip of a crutch that was used during experimentation.

The non-constant radius tip shown in FIG. 10 was laser cut from a 1 cm (0.375 in.) thick sheet of though Acetal Resin (Delrin) plastic using a 60 W laser cutter (Universal Laser System VLS4.60). A 0.6 cm (0.25 in.) thick strip of rubber (60 A Durometers) was screwed onto the rolling perimeter surface where the attachment screws were countersunk into the rubber. The non-constant radius tip was firmly fastened onto the bottom of an axillary crutch with a custom Acetal Resin (Delrin) plastic bracket. The entire crutch tip assembly (shape and bracket) had a total weight of approximately 470 g (1.0 lbs.).

The experiments compared the dynamic effects of crutch walking when using different non-constant radius tips and normal crutch tips. The experiment was split into two phases. Phase one focused on step length and swing time gait parameters, while also determining the steady state crutch walking velocity for each participant. In phase two, the subjects' ground reaction forces over the entire crutch gait cycle were measured. Axillary crutches were used for all phases and trials. Crutch height and grip location were adjusted according to crutch sizing standards for each participant. In order to compensate for the added weight of the non-constant radius tip assembly, matching lead weights were attached to the crutches when using a standard tip. Each subject walked one trial per tip setting where the order of crutch tip setting was randomized for each participant.

Four healthy male subjects, ages 24.25±1.7, with minimal to no crutch experience were included in this study. No subjects had any inherent gait or lower limb gait asymmetries and all wore non-constricting clothing with comfortable athletic shoes. Written informed consent was obtained from each subject prior to participation with a protocol approved by the Western Institutional Review Board.

Stride velocity, step length, and swing time were measured for each participant using the ProtoKinetics Zeno Walkway System (ProtoKinetics, LLC, Havertown, Pa.), which is a 2.0 ft. (0.6 m) by 16.0 ft. (4.9 m) walkway consisting of pressure sensors that are able to accurately monitor each step position. As used herein, foot step length is defined as the distance between the point where the crutches first touch down to the location where the foot first touches down. Crutch step length is defined the same way, but between the feet and crutch locations. Swing time is the time interval during which either the foot or crutch are off the ground during a step. Each participant was instructed to crutch walk for five minutes at a self-selected velocity over the Zeno Walkway.

Using a normal tip, a forward forcing/assisting non-constant radius tip, and a backward forcing/resisting non-constant radius tip, the participants walked back and forth over the Zeno Walkway. Participants turned (180 degrees) at a distance of approximately two strides before and after the mat to ensure steady state walking measurements. When turning, participants turned about an approximately 0.5 m radius half-circle. Before each trial, the participants rested until their resting heart rate was achieved. During each five-minute trial, each participant's continuous heart rate was recorded using a Bluetooth 4.0 Wahoo TICKR heart rate monitor controlled with a custom mobile application.

To correlate the gait data to when the participant reached a steady-state heart rate, a least square curve fit was used in MATLAB. The steady-state heart rate was defined as the heart rate after two time constants. The comfortable gait velocity for each participant was determined to be the average stride velocity during this steady state time interval. This is the velocity that was used for phase two as treadmill velocity. Step lengths for crutch step and leg step can be seen in FIG. 11.

For the second phase of the experiment, the participants were instructed to walk on a level instrumented split-belt treadmill with force plates (FIT, Bertec Corp., Columbus Ohio) underneath the treads. The treadmill is part of the CAREN (Computer Assisted Rehabilitation Environment) system (Motek Medical, Amsterdam). Participants followed their same crutch tip trial pattern, while walking for two minutes per trial. The treadmill velocity was set at the steady-state velocity from phase one. The instrumented treadmill measured horizontal (anterior-posterior) and vertical ground reaction forces of the participants during crutch walking at 100 Hz.

Figure 11:
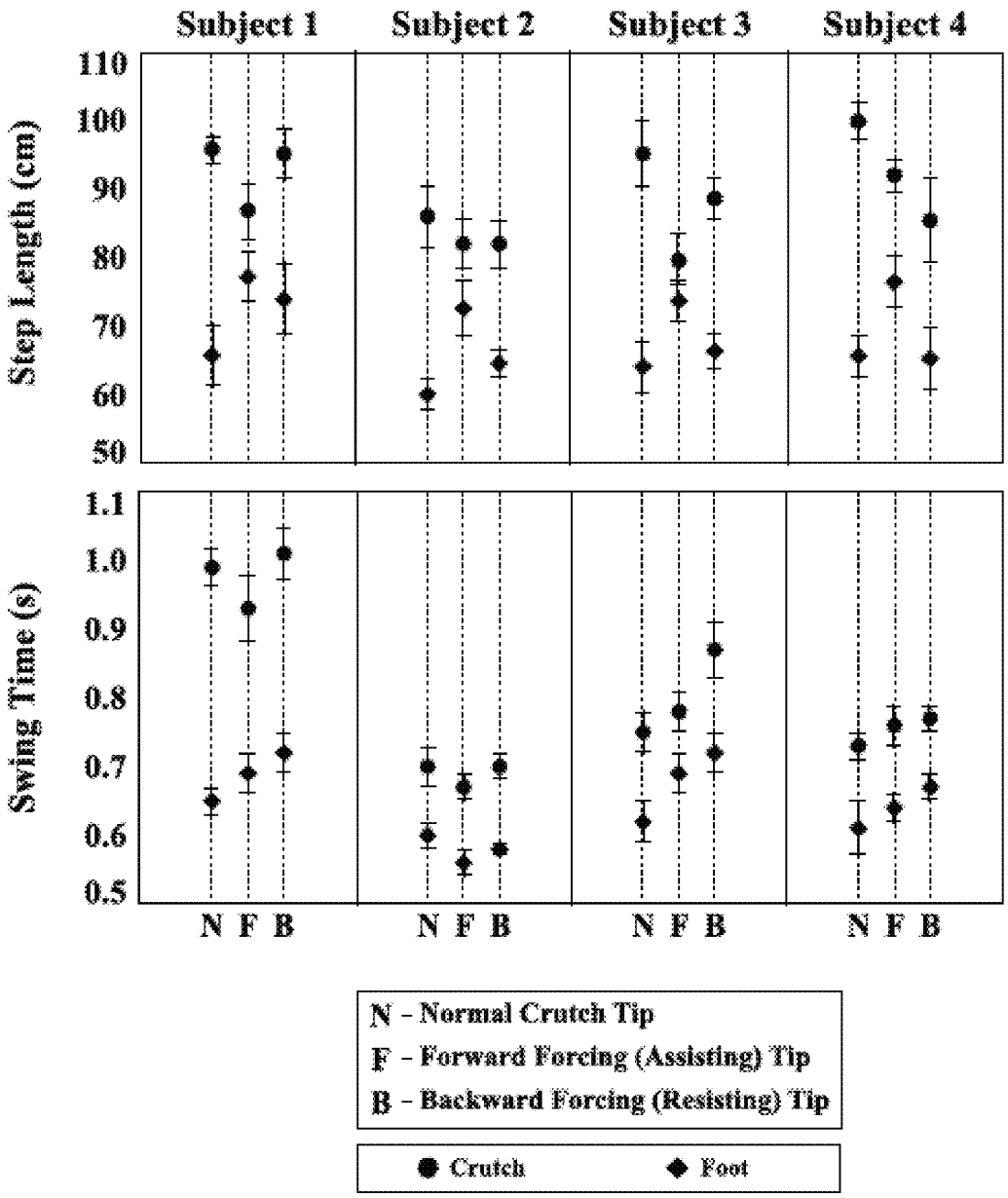
FIG. 11 includes graphs that provide a step length and swing time results comparison between a constant and non-constant radius crutch tip.

The introduction of the non-constant radius tip to a swing-through non-weight bearing crutch walk has a quantifiable effect on the dynamics of crutch walking. FIG. 11 shows key trends in how the non-constant radius tip changes participants' crutch and foot step length and swing time. The non-constant radius tip reduces the difference between crutch and foot step length in both the forward and backward forcing orientations when compared to a normal constant-radius tip. Using the forward forcing non-constant radius tip orientation, the foot step length is increased, while crutch step length is decreased for all subjects when compared to the normal tip. For three of the four participants there is a clear trend in increasing foot swing time from normal to forward, and again from forward to backward non-constant radius tip orientations. All participants showed highest crutch swing time for the backward non-constant radius tip.

The difference between the anterior-posterior horizontal forces created by the forward and backward non-constant radius tip results in the change in momentum and swing velocities of the user. This could lead to the observed crutch and foot swing time shown in FIG. 11. Although firm patterns were shown for swing time change globally among all subjects, the non-constant radius tip was able to manipulate swing time.

Figure 12:
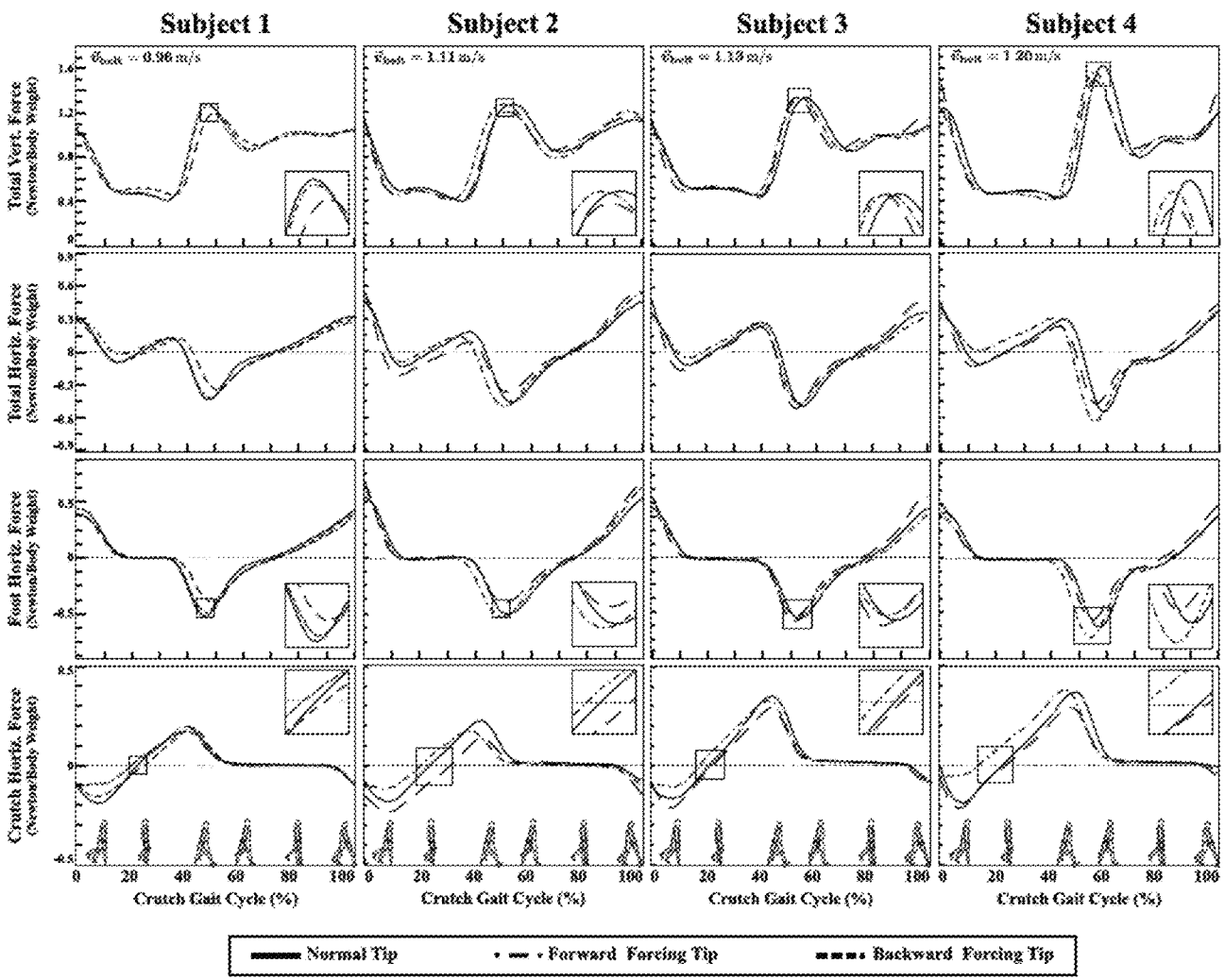
FIG. 12 includes graphs that provide a ground reaction force results comparison between a constant and non-constant radius crutch tip.

Noticeable trends were observed in the ground reaction forces when using the different non-constant radius tips (FIG. 12). Equation 1 is used for quantitative comparisons.

$$\%\ \text{Change} = \frac{K_{Tip} - N_{Tip}}{N_{Tip}} \cdot 100 \qquad \text{(Equation 1)}$$

The measured parameter value from the non-constant radius tip (either forward or backward) is denoted as $K_{Tip}$ and the measured parameter value from the normal crutch tip as $N_{Tip}$. As used herein, GC stands for gait cycle.

During crutch strike (0-20% GC), the forward forcing non-constant radius tip reduced the posterior force by up to 74% from the normal tip, while the backward orientation increased by up to 34% from the normal tip. It was observed that the ground reaction forces switch from posterior to anterior (equilibrium point) during crutch stance around 21±1% GC for the normal non-constant radius tip, 17±3% GC when using the forward non-constant radius tip, and 24±3% GC for the backward non-constant radius tip. This may be due to the shifting of the entire horizontal ground reaction force curve up for the forward non-constant radius tip and down for the backward non-constant radius tip, which is precisely what the tip was hypothesized to accomplish. Among all subjects, the forward forcing non-constant radius tip creates a larger positive shift in horizontal ground reaction forces as the crutch walking velocity increases.

Along with the force magnitudes during crutch stance, this time shift of crutch stance equilibrium causes changes in impulse (force times time) during crutch strike and crutch push-off. The observed reduction in peak forces and impulses during crutch stance is predicted to alleviate stresses in the user's wrist, elbow, and shoulders, however, joint forces were not directly measured in the study. During foot heel strike (40-60% GC), the forward forcing non-constant radius tip increased the peak force by 15%, while the backward tip decreased the peak force by 24% both compared to the normal tip. Among all participants, the vertical heel impact force with a non-constant radius tip was either equivalent or less than the impact force with a normal tip, however, the crutch walking velocity between subjects appears to affect this peak force change. There was no significant force profile difference between all tested non-constant radius tips during mid foot stance (60-85% GC). For three out of four participants, the horizontal foot push-off force (85-100% GC) was increased when using the backward non-constant radius tip, indicating a slightly higher plantarflexion effort by the user to initiate crutch stance. Although the forward forcing non-constant radius tip resulted in high crutch stance force profile modification, no significant changes or trends using this crutch tip during foot stance or push-off were observed.

In all subjects, the forward forcing non-constant radius tip created additional assistive forces during crutch stance, while a backward forcing non-constant radius tip caused an increase in resistive forces. The changes in forces during crutch stance affected the subsequent leg stance phase forces. Horizontal and vertical heel strike ground reaction forces were reduced for three out of four subjects using a backward forcing non-constant radius tip, while user foot push-off force increased for three out of four subjects. These results indicate that a non-constant radius tip can be used to create desirable variations in crutch walking dynamics. Because the assistive and resistive crutch ground reaction forces on a flat surface could be manipulated, a non-constant radius tip is able to provide controlled resistance for downhill walking while increasing assistance in uphill ambulation.

A study comparing two different non-constant radius tips with the standard point crutch tip was also performed. The highlights of this study are described below. Three distinctly different crutch tips were investigated:

1. A constant backward/resisting force profile non-constant radius tips that transfers 30% of the user weight against the direction of motion (Backward Forcing—BF),
2. A constant forward/assisting force profile non-constant radius tip that transfers 30% of the weight in the direction of motion (Forward Forcing—FF), and
3. A standard rubber point crutch tip (constant radius) that applies no additional propulsion or braking forces (Standard Tip—STD).

Both BF and FF (1 and 2) crutch tips were the same crutch tip reversed 180 degrees and can be seen in FIG. 10. Each of the three crutch tips was tested on underarm crutches and forearm crutches. Each combination was tested three times, yielding a total of 18 trials with one participant (healthy, 28 yrs., 98 kg, IBR consent) crutch-walking over ground with a non-weight bearing swing-through crutch gait. The crutch and participant's body motion were recorded using a motion tracker infrared camera system (100 Hz) distributed over a 30 ft. walking corridor. Reflective markers were placed on the participant's feet, hips, and shoulders, and also distributed linearly along each crutch. The ground forces and moments applied by the crutch tip onto the ground were measured with two force plates (960 Hz). The dimensions of the force plates were 51 cm×51 cm each. The participant completed two strides before pivoting the crutches over the force plates, after which they proceeded to complete two more strides.

The recorded movements and ground forces were filtered with a second order Butterworth low-pass filter (15 Hz). The forward velocity of the user's hips for three trials per crutch tip type and crutch type combination were averaged and displayed with a standard deviation cloud. Using the measured trajectory and ground force data of the participant as they pivoted over the crutch, how each crutch tip affected the participant's landing angle, velocity profile, horizontal (front/back, propulsion/braking) force profile, the total work done by the crutch tip Work=$\int F(t)v(t)dt$, and total impulse applied to the user by the crutch Impulse=$\int F(t)dt$ were examined. The impulse is often times referred to as the crutch-force-time integral (CFTI) and can be used as an indicator of energy consumption.

Figure 13:
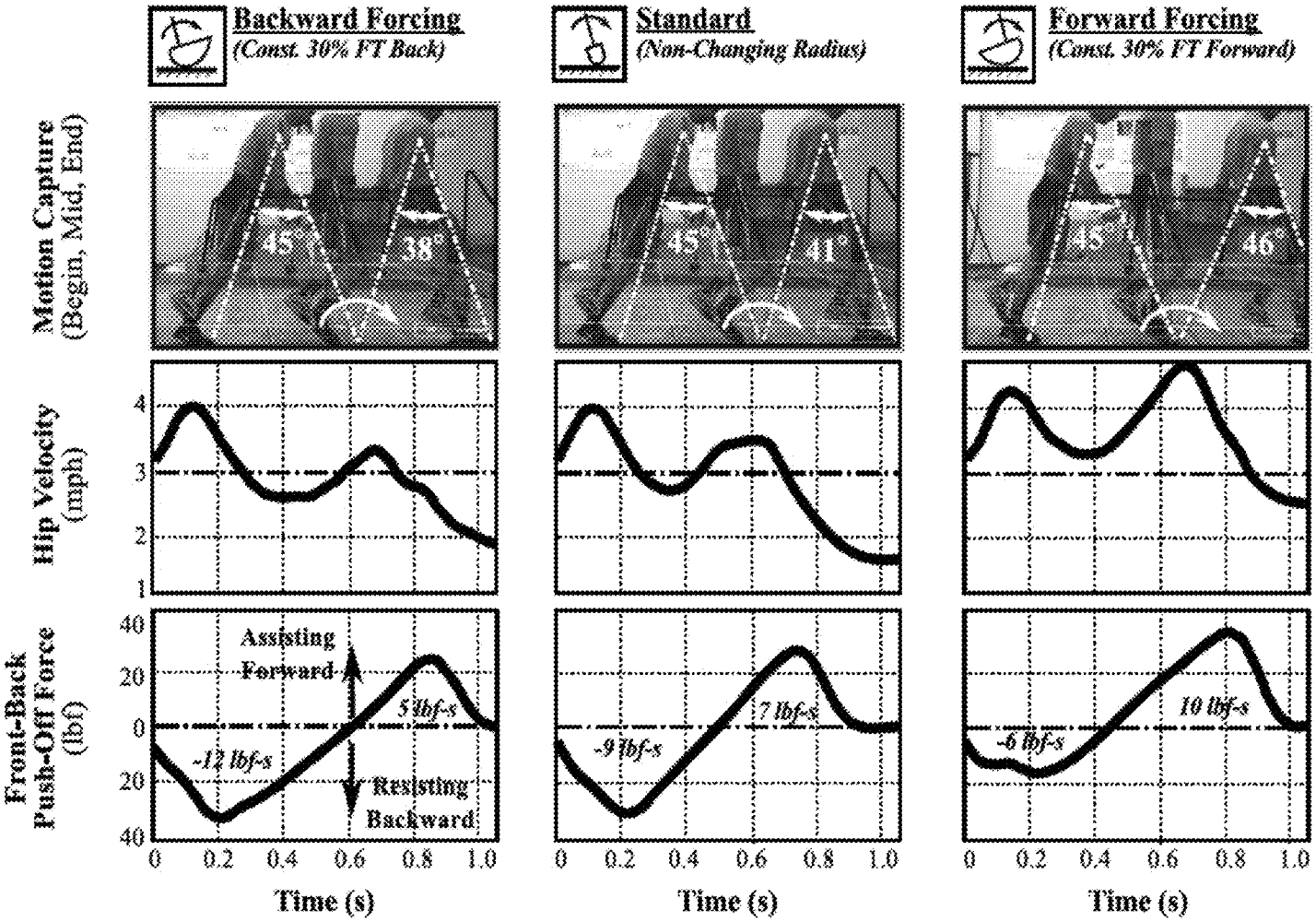
FIG. 13 includes graphs that provide a tip landing angle, hip velocity, and ground reaction force comparison between an increasing radius (backward forcing, resisting), a normal constant radius, and a decreasing radius (forward forcing, assisting) crutch tip.
Figure 14:
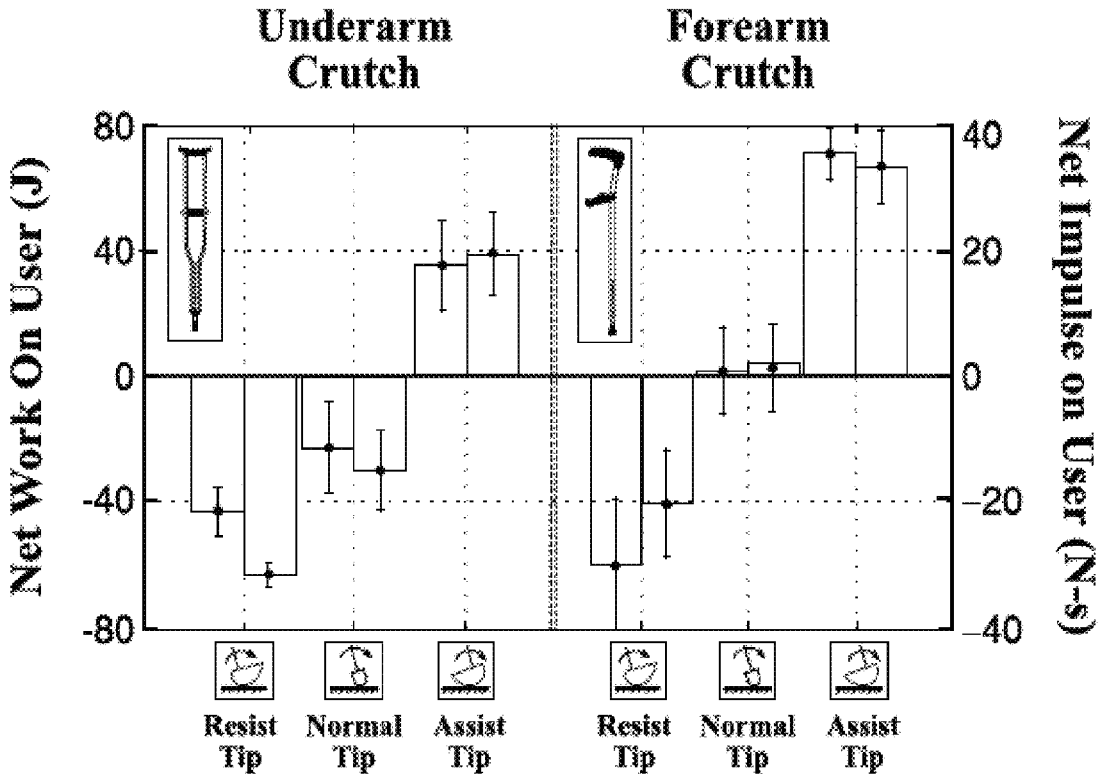
FIG. 14 includes graphs that show the net work and net impulse provided by the user using three different crutch tips and two different crutches.

A summary of the discussed results can be seen in FIGS. 13 and 14. The non-constant radius tip showed significant effects on body mechanics during crutch pivot. The measured ground forces indicate that the resisting/braking/backward forcing non-constant radius tip (30% backward force transfer) consistently shifts the entire horizontal ground force profile into the negative, which results in an overall net negative force (more resisting) (FIG. 13). This moves the "neutral/equilibrium" point, where the user experiences zero horizontal push, to later in the crutch stance phase followed by a smaller push-off peak. This temporal shift in horizontal (front/back) ground forces with decreasing radius change value of a non-constant radius tip (i.e., BF non-constant radius tip shifts force neutral point to the right) resembles the same force-shifting pattern during normal decline walking with decreasing slope value. This consistent negative shift of the force profile yields an overall lower user velocity profile and a lower terminal body pose angle at landing. As seen in FIG. 14, the net work done by the BF non-constant radius tip during crutch pivot consistently had twice the resisting force (negative) than that of a standard crutch tip when used with an underarm crutch. With the forearm crutch, the BF non-constant radius tip magnitude was around ten times the resisting value compared to a standard crutch tip, but in the opposite direction.

The net impulse (force applied by the tip over the time spent on the crutch) followed a similar trend (FIG. 14). The FF non-constant radius tip was able to produce a different force profile than the backward forcing tip; the ground force profile was shifted into the positive, lowering initial rolling resistance and providing the participant with a larger and longer push-off force.

As seen in FIG. 13, the peak forward velocity of the user prior to landing was 1.0 mph (1.6 kph) more than a standard crutch tip and around 1.5 mph (2.4 kph) more than a backward forcing non-constant radius tip. This speed increase consequently leads to a greater landing angle. While standard crutch tips either produce a net negative (underarm) or neutral (forearm) work and impulse, there is a considerable increase in the total work done by the FF non-constant radius tip onto the user, generating a net positive work that propels the crutch user forward. This work and impulse increase for assisting FF non-constant radius tips is higher when used with forearm crutches, generating 67 J per step and 36 N-s per step, respectively.

In summary, on all measured performance metrics in this example, the backward forcing non-constant radius tip consistently resisted user dynamics, the forward forcing non-constant radius tip assisted user dynamics, and a conventional crutch tip performed between the two. Hence, with the non-constant radius tip it is possible to systematically and predictably change the dynamics of a person ambulating with a crutch. Note that the prior vast amount of quantitative research has been spent on the analysis of various crutch walking dynamics, however little focus has been done to effectively alter crutch walking dynamics.

Figure 15:
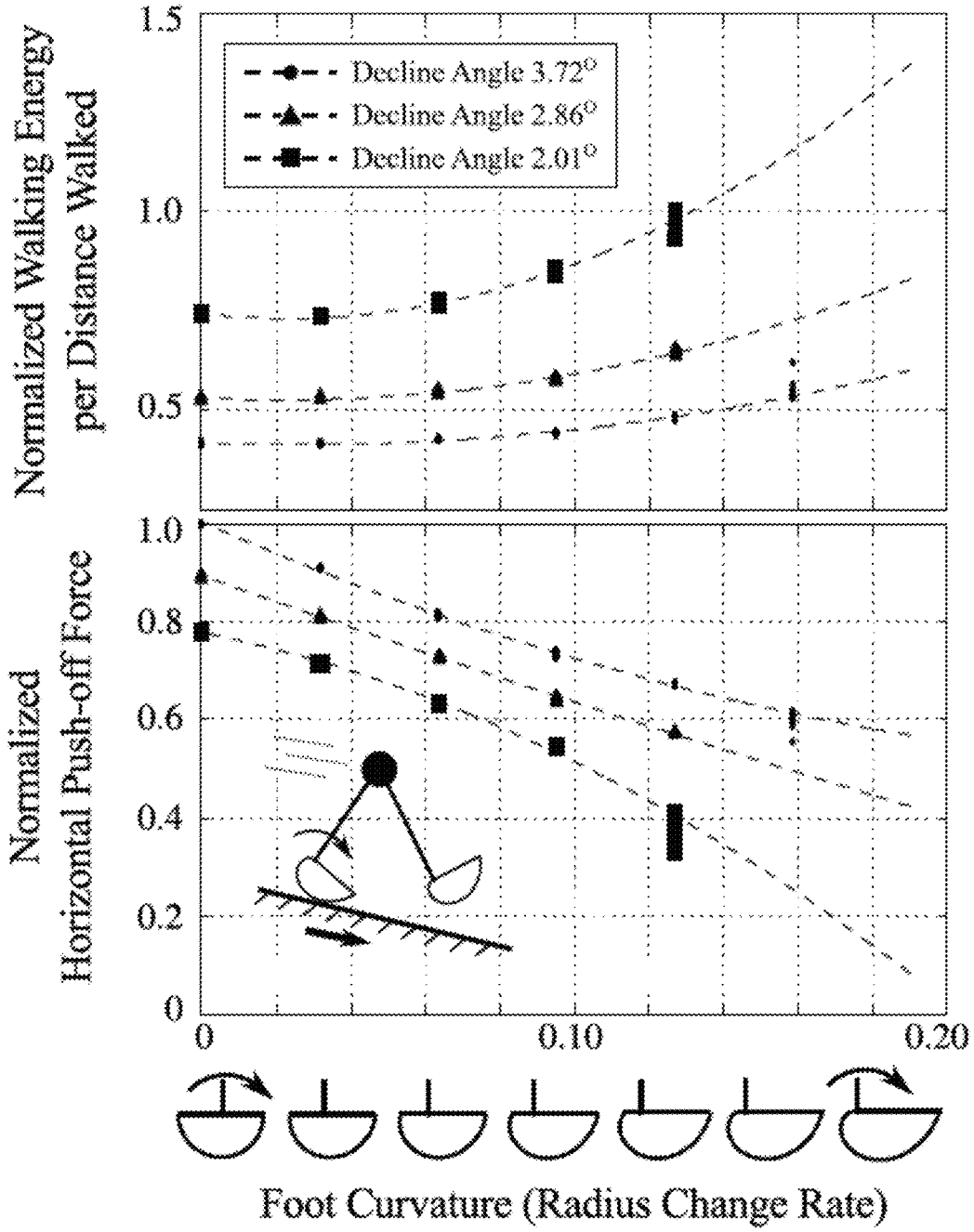
FIG. 15 includes graphs that show the normalized walking energy and push-off ground reaction forces of a dynamic crutch walking computer simulation model, which simulates walking on crutches with a non-constant radius tip.

The results from this experiment are in agreement with the results of the supplemental numerical computer model of a crutch user walking on a curved crutch tip down a decline with a non-weight bearing swing-through crutch gait. The passive dynamic crutch-walking model, based on the passive dynamic walker, simulates slow walking down a slope based solely on gravitational forces, where its dynamics are determined by the magnitude of the slope, its weight, height, and the curvature of the feet and crutch tips. The model parameters that included the decline angle and crutch tip shape were iterated numerically, while only stable gaits were considered. While actual crutch walking requires shoulder and lower limb actuation, this model gives an insight into the swinging and pivoting dynamics of crutch walking. As seen in FIG. 15, as the curvature increases (increasing radius and resistance), the virtual model uses more energy per distance walked, while also losing the horizontal propulsive force that the decline provides. The increasing radius is identical to a backward/resisting (BF) non-constant radius tip that negates the effect of the decline and so slowing the walker down in order to gain stability.

Figure 16A:
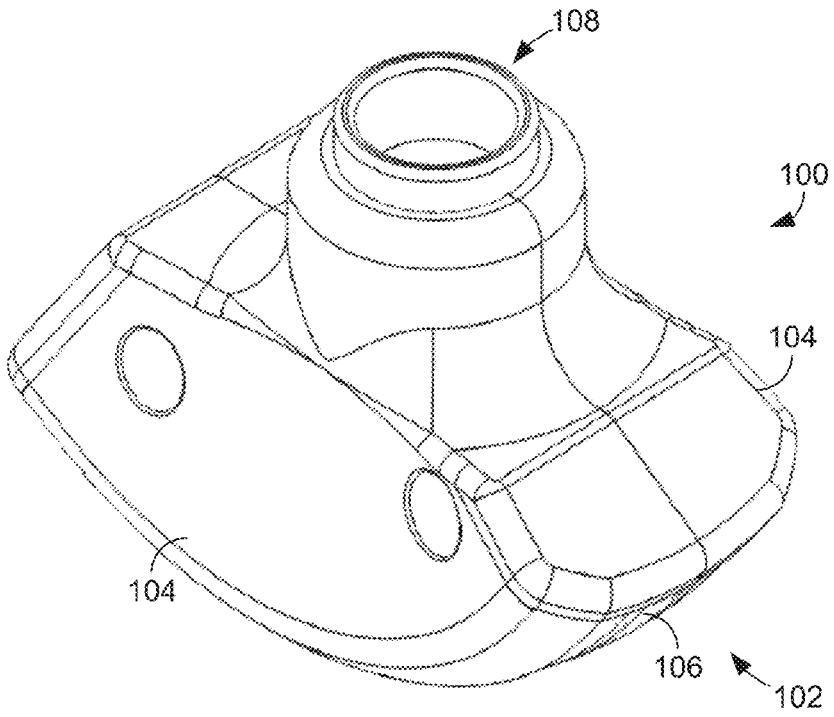
FIG. 16A is a top perspective view of a first example design for a non-constant radius curved tip.
Figure 16B:
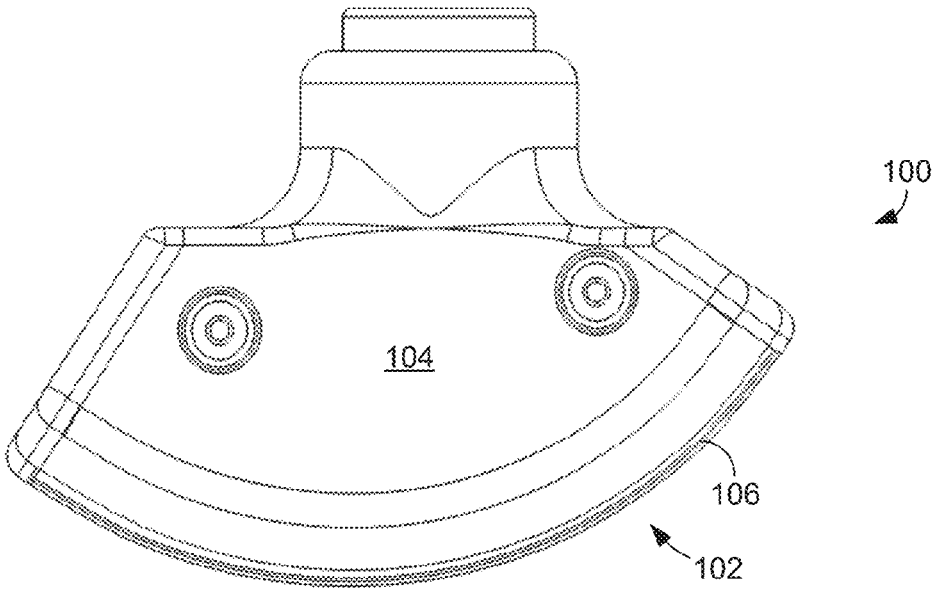
FIG. 16B is a side view of the curved tip of FIG. 16A.
Figure 16C:
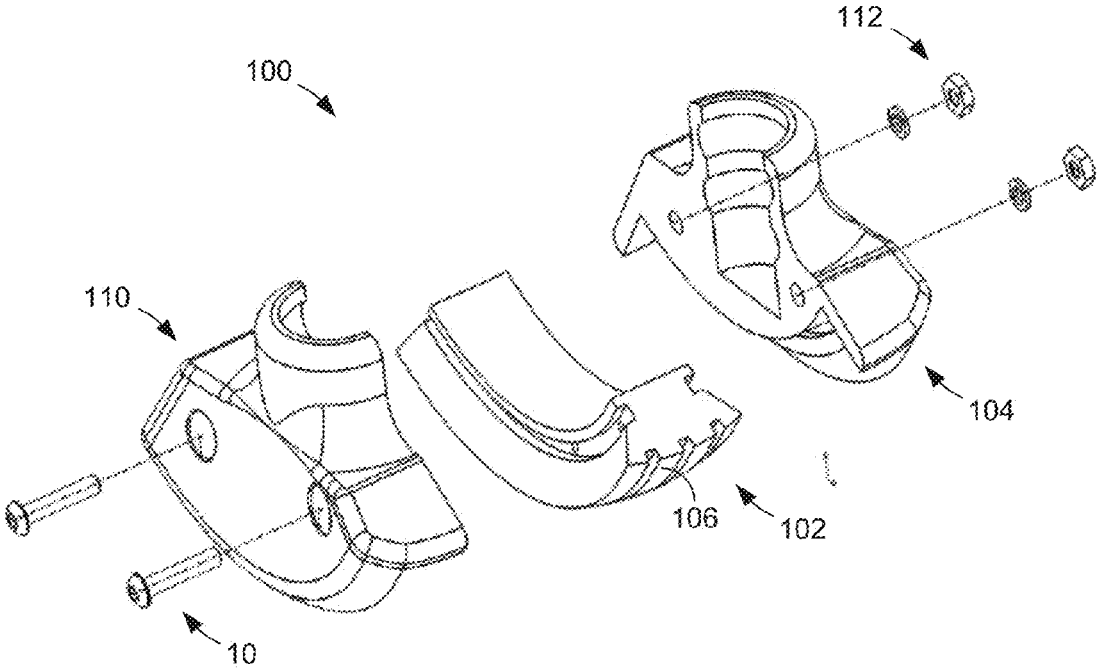
FIG. 16C is a perspective exploded view of the curved tip of FIG. 16A.

FIGS. 16 and 17 illustrate particular designs for a non-constant radius curved tip for use with a walking assistance device, such as a crutch or cane. Beginning with FIG. 16, a non-constant radius curved tip 100 includes a curved outer surface 102. The curved tip 100 is composed of three main parts, including first and second lateral body portions 104, which can be made of a rigid material such as plastic or metal, and a central member 106, which can be made of a resilient material, such as rubber. The central member 106 forms the curved outer surface 102 of the curved tip 100 that contacts the ground or floor surface. As shown in FIG. 16A, the body portions 104 together define an opening 108 that is adapted to receive the leg (or other vertical member) of the walking assistance device. As shown in FIG. 16C, the three parts 104, 106 can be secured together with conventional fasteners, such as threaded bolts 110 and nuts 112. In some embodiments, the central member 106 can be replaceable so that when it becomes worn or damaged through use, it can be replaced with a new member. In further embodiments, multiple interchangeable central members 106 can be available that have different parameters, such as different tread patterns, different materials, different dimensions, and so forth.

Turning to FIG. 17, illustrated is a non-constant radius curved tip 120 that includes a curved outer surface 122. In this example, the outer surface 122 has a radius that varies in multiple directions, including front-to-back and side-to-side. Accordingly, the curved tip 120 can assist the user in multiple directions at the same time. Like the curved tip 100, the curved tip 120 also includes an opening 108 that is adapted to receive the leg (or other vertical member) of the walking assistance device.

The invention claimed is:

1. A walking assistance device, the device comprising:

a support member adapted to support a user of the device; and a curved tip mounted to the support member, the curved tip comprising a curved outer surface adapted to contact the ground or a floor surface during use of the device, the curved outer surface defining a continuous, uninterrupted curve extending from a front end of the surface to a rear end of the surface, the curve having a non-constant radius that continuously increases as a function of angular position along the curved outer surface from the front end of the surface to the rear end of the surface or from the rear end of the surface to the front end of the surface, wherein the non-constant radius is explicitly configured to apply assistive forces that assist the user.

2. The walking assistance device of claim 1, wherein the device is a crutch and the support member is a leg of the crutch.

3. The walking assistance device of claim 1, wherein the device is a cane and the support member is a shaft of the cane.

4. The walking assistance device of claim 1, wherein curved outer surface comprises no flat surface that is adapted to contact the ground.

5. The walking assistance device of claim 1, wherein the curved outer surface is a smooth, gradually changing surface devoid of sharp angles.

6. A non-constant radius curved tip for use with a walking assistance device, the curved tip comprising:

a curved outer surface adapted to contact the ground or a floor surface during use of the device, the curved outer surface defining a continuous, uninterrupted curve extending from a front end of the surface to a rear end of the surface, the curve having a non-constant radius that continuously increases as a function of angular position along the curved outer surface from the front end of the surface to the rear end of the surface or from the rear end of the surface to the front end of the surface, wherein the non-constant radius is explicitly configured to apply assistive forces that assist the user.

7. A method for assisting a user with a walking assistance device, the method comprising:

providing a user with a walking assistance device having a tip comprising a curved outer surface adapted to contact the ground or a floor surface during use of the device, the curved outer surface defining a continuous, uninterrupted curve extending from a front end of the surface to a rear end of the surface, the curve having a non-constant radius that continuously increases as a function of angular position along the curved outer surface from the front end of the surface to the rear end of the surface or from the rear end of the surface to the front end of the surface; and applying assistive forces to the walking assistance device with the non-constant radius when the user places weight on the walking assistance device, wherein the assistive forces assist the user.

8. A walking assistance device, the device comprising:

a support member adapted to support a user of the device; and a curved tip mounted to the support member, the curved tip comprising a curved outer surface adapted to contact the ground or a floor surface during use of the device, the curved outer surface defining a continuous, uninterrupted curve extending from a right edge of the surface to a left edge of the surface, the curve having a non-constant radius that continuously increases as a function of angular position along the curved outer surface from the right edge of the surface to the left edge of the surface or from the left edge of the surface to the right edge of the surface, wherein the non-constant radius is explicitly configured to apply assistive forces that assist the user.

9. The walking assistance device of claim 8, wherein the device is a crutch and the support member is a leg of the crutch.

10. The walking assistance device of claim 8, wherein the device is a cane and the support member is a shaft of the cane.

11. A non-constant radius curved tip for use with a walking assistance device, the curved tip comprising:

a curved outer surface adapted to contact the ground or a floor surface during use of the device, the curved outer surface defining a continuous, uninterrupted curve extending from a right edge of the surface to a left edge of the surface, the curve having a non-constant radius that continuously increases as a function of angular position along the curved outer surface from the right edge of the surface to the left edge of the surface or from the left edge of the surface to the right edge of the surface, wherein the non-constant radius is explicitly configured to apply assistive forces that assist the user.

12. A method for assisting a user with a walking assistance device, the method comprising:

providing a user with a walking assistance device having a tip comprising a curved outer surface adapted to contact the ground or a floor surface during use of the device, the curved outer surface defining a continuous, uninterrupted curve extending from a right edge of the surface to a left edge of the surface, the curve having a non-constant radius that continuously increases as a function of angular position along the curved outer surface from the right edge of the surface to the left edge of the surface or from the left edge of the surface to the right edge of the surface; and applying assistive forces to the walking assistance device with the non-constant radius when the user places weight on the walking assistance device, wherein the assistive forces assist the user.

* * * * *